United States Patent [19]

Popescu

[11] 4,242,182

[45] Dec. 30, 1980

[54] BRIGHT TIN ELECTROPLATING BATH

[76] Inventor: Francine Popescu, 32, rue E. Dolet, 94100 Saint Maur, France

[21] Appl. No.: 926,891

[22] Filed: Jul. 21, 1978

[51] Int. Cl.[3] ..... C25D 3/30

[52] U.S. Cl. ..... 204/54 R

[58] Field of Search ..... 204/54 R

[56] References Cited

U.S. PATENT DOCUMENTS

| | | | |
|---|---|---|---|
| 3,471,379 | 10/1969 | Schoot et al. | 204/54 R |
| 3,616,306 | 10/1971 | Conoby et al. | 204/54 R |
| 3,755,096 | 8/1973 | Passol | 204/54 R |

*Primary Examiner*—Howard S. Williams

*Attorney, Agent, or Firm*—Gifford, Van Ophem, Sheridan & Sprinkle

[57] ABSTRACT

Improved electrolytic tin deposition from aqueous, acid electroplating baths is achieved by addition of a new formula of brighteners. These results are achieved by further addition of unsaturated aliphatic acids or their derivates and still better results are achieved by further addition of certain heterocyclic quarternary compounds.

13 Claims, No Drawings

BRIGHT TIN ELECTROPLATING BATH

BACKGROUND OF THE INVENTION

This invention relates to the electrolytis deposition of bright tin from aqueous, acid electroplating baths and, more particularly, to new brightening agents useful in bright acid tin electroplating.

SUMMARY OF THE INVENTION

According to one aspect of this invention, it has been found that uniform, ductile and lustrous tin electrodeposits are obtained from an aqueous acidic solution of bivalent tin ions containing additionally:

(a) 20 to 200 grams per liter of a free mineral acid, namely sulfuric acid and/or fluoboric acid;

(b) 1 to 20 grams per liter of a dispersing or emulsifying agent selected from the group of nonionic wetting agents derived from ethylene oxide or propylene oxide, or from the group of cationic or ampholytic wetting agents derived from imidazoline; the prefered dispersing agents are the alkylphenoxypoly(ethyleneoxy)ethanols with 10 to 20 moles of ethylene oxide in their molecule (in the Table 1 are given a few, nonlimiting examples of dispersing agents which may be utilized according to this invention);

(c) 0.02 to 0.7 grams per liter of a brightener dispersed in said bath and defined by the general formula:

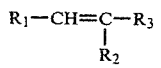

(I)

wherein:

$R_1$ is

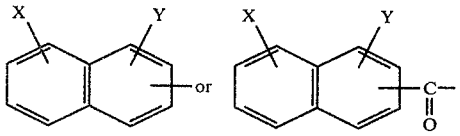

(II) (III)

X and Y being each, independently one of another, a hydrogen atom, a halogen atom or a substituent selected from the hydroxy, alkoxy or alkyle groups;

$R_2$ is hydrogen or alkyle; and $R_3$ is

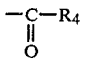

when $R_1$ is (II), or $R_3$ is

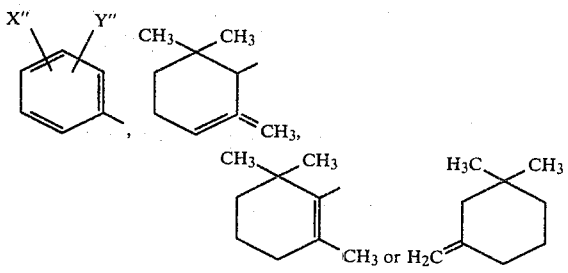

when $R_1$ is (III);

$R_4$ being alkyl, phenyl, hydroxyphenyl, alkoxyphenyl, dialkoxyphenyl, alkylphenyl, pyridyl, alkylpyridyl or hydroxypyridyl; and X" and Y" being each, independently one of another, hydrogen, halogen, hydroxy, alkoxy, alkyl, sulfoxy, carboxy, amino or amido or they can form together the methylenedioxy group.

Table 2 gives non limiting examples of brighteners of formula (I) in conformity with this invention.

The acid tin electroplating baths comprising at least one compound of each category (a), (b) and (c) described above, produce fine grained and semi-bright tin electrodeposits, with good throwing power.

According to another aspect of this invention, the brighteners and additives described above are associated, in the acid tin electroplating bath, with 0.1 to 5.0 grams per liter of an unsaturated aliphatic acid comprising 3 to 6 carbon atoms in its molecule, or with one of its derivatives, compatible with the plating bath, namely the aliphatic esters and amides of the unsaturated aliphatic acids (with double or triple bond), including their hydroxylated or halogenated substitution derivatives. These additives are dissolved or dispersed in the plating bath.

In Table 3 there are given non limiting examples of aliphatic non saturated acids and their derivatives which may be utilized as bright tin additives, according to the present invention.

The acid tin electroplating baths containing at least one compound of each category (a), (b) and (c) described above plus at least one unsaturated compound in conformity with those illustrated in Table 3, produce very bright, uniform, ductile and levelled tin electrodeposits, with good throwing power.

TABLE 1

EMULSIFYING AND DISPERSING AGENTS (b)

| | Compound | Optimal concentration in the tin bath g/l |
|---|---|---|
| 1 | Nonylphenoxypoly(ethyleneoxy)ethanol with 10 moles of ethylene oxide in its molecule | 2–10 |
| 2 | Octylphenoxypoly(ethyleneoxy)ethanol with 12 moles of ethylene oxide in its molecule | 2.5–12 |
| 3 | Ethoxylated beta-naphtol with 11 moles of ethylene oxide in its molecule | 1.5–9.0 |
| 4 | Ethoxylated trimethylnonanol with 15 moles of ethylene oxide in its molecule | 4–8 |
| 5 | Imidazoline derivative of coconut fatty acid | 3–7 |

TABLE 2
BRIGHTENERS OF FORMULA (I)
| Compound | Optimal concentration in the tin plating bath g/l |
|---|---|
| (1) 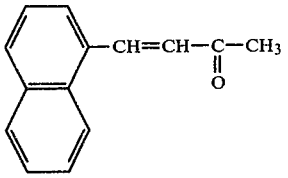 4-(1-naphthyl)-3-butene-2-one | 0.08–0.4 |
| (2) 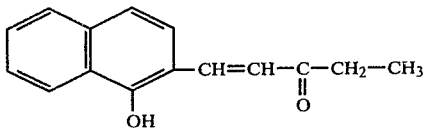 1-(1-hydroxy-2-naphthyl)-1-pentene-3-one | 0.03–0.25 |
| (3) 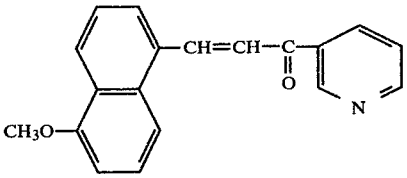 3-(3-pyridyl)-3-one-1(5-methoxy-1-naphthyl)-1-propene | 0.07–0.2 |
| (4) 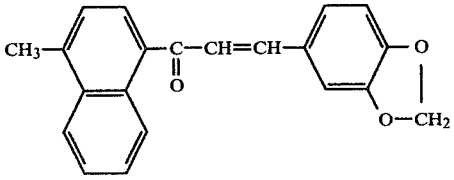 1-(4-methyl-1-naphthyl)-1-one-3-piperonyl-3-propene | 0.1–0.35 |
| (5) 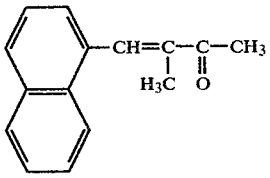 2-methyl-1-(1-naphthyl)-1-butene-3-one | 0.1–0.3 |
| (6) 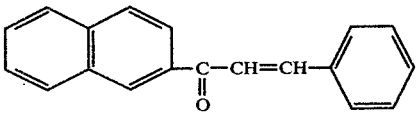 styryl-2-naphthyl-ketone | 0.08–0.2 |
| (7) 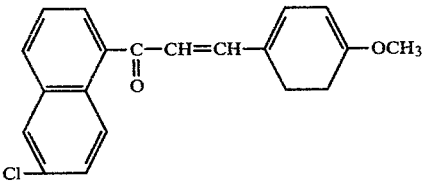 p-methoxystyryl-1-(6-chloronaphthyl)-ketone | 0.1–0.3 |
| (8) 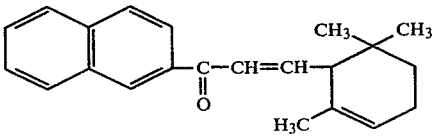 | 0.08–0.25 |

TABLE 2-continued

BRIGHTENERS OF FORMULA (I)

| | Compound | Optimal concentration in the tin plating bath g/l |
|---|---|---|
| (9) | 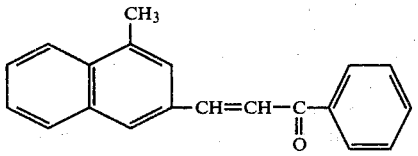 1-(4-methyl-2-naphthyl)-1-propene-3-phenyl-3-one | 0.1–0.4 |
| (10) | 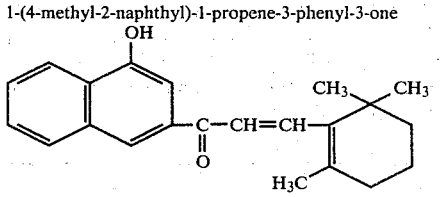 | 0.1–0.5 |
| (11) | 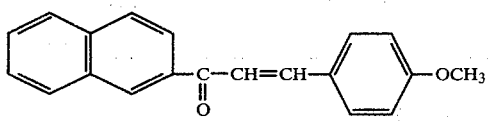 p-methoxystyryl-2-naphthyl-ketone | 0.12–0.40 |

TABLE 3

ALIPHATIC NON SATURATED ACIDS AND THEIR DERIVATIVES

| | Compound | Optimal concentr. in the tin plating bath g/l |
|---|---|---|
| (1) | $H_2C{=}CH{-}COOH$ | 0.5–1.8 |
| (2) | $H_2C{=}C(CH_3){-}COOH$ | 0.5–1.5 |
| (3) | $H_2C{=}CH{-}C(=O){-}O{-}CH_3$ | 0.3–2.0 |
| (4) | $H_2C{=}CH{-}C(=O){-}O{-}CH_2{-}CH_2{-}OH$ | 0.5–2.5 |
| (5) | $H_2C{=}CH{-}C(=O){-}NH_2$ | 0.4–1.5 |
| (6) | $CH_3{-}CH{=}CH{-}C(=O){-}OH$ | 0.4–1.5 |
| (7) | $H_2C{=}C(C(=O){-}OH){-}CH_2{-}C(=O){-}OH$ | 0.5–2.0 |
| (8) | $H_2C{=}CH{-}C(=O){-}O{-}CH_2{-}CH(OH){-}CH_2{-}O{-}CH_2{-}C{\equiv}C{-}CH_2{-}OH$ | 0.2–1.5 |
| (9) | $HC{\equiv}C{-}C(=O){-}OH$ | 0.5–1.5 |
| (10) | $HC{\equiv}C{-}C(=O){-}O{-}CH_2{-}CH_3$ | 0.1–1.0 |
| (11) | $HO{-}C(=O){-}CH_2{-}CH_2{-}C(=O){-}OH$ | 0.1–2.0 |
| (12) | $CH_3{-}CH{=}C(CH_3){-}C(=O){-}OH$ | 0.6–1.8 |
| (13) | $H_2C{=}C(Cl){-}C(=O){-}O{-}CH_3$ | 0.2–1.2 |

The field of application of this invention extends to the association, in the tin plating bath, of the above described brighteners with other known additives, compatibles with the said bath, such as aromatic aldehydes and ketones, ethylenic aromatic ketones, aromatic acids and quaternary pyridinium derivatives.

According to another object of this invention, a preferred combination of additives—allowing a wide bright plating range of cathodic current densities, consists of the addition, in the tin plating bath, of one of the compounds belonging to each of classes (a), (b) and (c) described above, of a non saturated compound such as those detailed in Table 3 and of an heterocyclic quaternary compound corresponding to the formula:

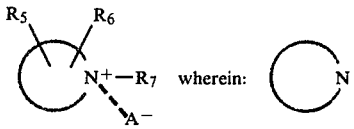

('IV)

represents a compound of the series of pyridine, quinoline or isoquinoline $R_5$ AND $R_6$ are, independently one of another, a hydrogen atom, a halogen atom or a hydroxy, alkyl, alkoxy, carboxy, carboxy-ester, sulfoxy, amino, amido or acetyl group;

$R_7$ is alkyl, alkenyl, alkynyl, benzyl alkylphenyl, hydroxyalkyl or haloalkyl; the alkyl or alkylphenyl groups may be carboxy substituted; and A is an anion or A is nothing when the polarity of the nitrogen atom is neutralized by another constituent of the molecule.

The additives of formula (IV) are added in the tin electroplating bath in a concentration comprised, preferably, between 0.05 and 2.0 grams per liter of bath.

The Table 4 gives non limiting examples of quaternary compounds of formula (IV) which may be associated favorably with the brighteners of formula (I), according to this invention.

TABLE 4

QUATERNARY COMPOUNDS OF FORMULA (IV)

| Compound | Optimal concentration in the tin plating bath g/l |
|---|---|
| (1) 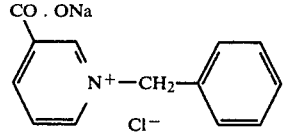 | 0.1–0.8 |
| (2) 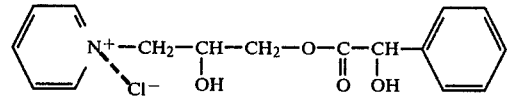 | 0.1–1.2 |
| (3) 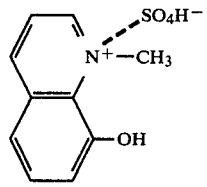 | 0.15–1.5 |
| (4) 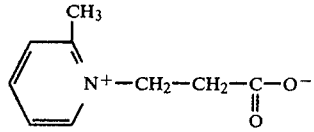 | 0.08–1.0 |
| (5) 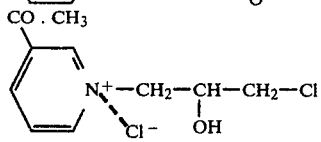 | 0.05–1.0 |
| (6) 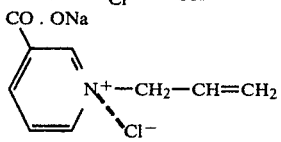 | 0.05–0.5 |
| (7) 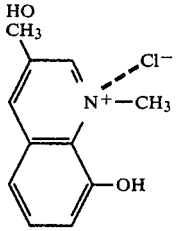 | 0.1–0.5 |

The following examples illustrate, in a nonlimiting way, the application of this invention:

EXAMPLES

Example 1—Semi-bright tin electroplating bath

| | |
|---|---|
| Stannous sulfate | 30 g/l |
| Sulfuric acid (d = 1,83) | 180 g/l |
| Nonylphenoxypoly(ethyleneoxy) ethanol with 10 moles of ethylene oxide in molecule | 4 g/l |
| Compound N° 1 of Table 2 | 0.15 g/l |

An uniform tin electrodeposit is obtained at the cathode, of fine grain and semi-bright aspect, under a cathodic current density of 0.5 to 4.0 A/dm$^2$, a bath temperature of 20°-30° C. and under cathodic agitation.

EXAMPLE 2—Bright tin electroplating bath

| | |
|---|---|
| Stannous sulfate | 40 g/l |
| Sulfuric acid | 200 g/l |
| Nonylphenoxypoly(ethyleneoxy)ethanol with 10 moles of ethylene oxide | 4 g/l |
| Compound N° 1 of Table 2 | 0.15 g/l |
| Compound N° 4 of Table 3 | 0.9 g/l |

Under the same conditions as for the example 1, there is obtained a very bright and uniform tin electrodeposit.

EXAMPLE 3—Bright tin electroplating bath

| | |
|---|---|
| Stannous sulfate | 30 g/l |
| Sulfuric acid | 200 g/l |
| Compound N° 3 of Table 1 | 5 g/l |
| Compound N° 7 of Table 2 | 0.18 g/l |
| Compound N° 1 of Table 3 | 1.2 g/l |
| Compound N° 2 of Table 4 | 0.2 g/l |

Bright and levelled tin electrodeposits are obtained at 0.3 to 8 A/dm$^2$ cathodic current density and under agitation.

EXAMPLE 4—Bright tin electroplating bath

| | |
|---|---|
| Stannous sulfate | 26 g/l |
| Sulfuric acid | 170 g/l |
| Compound N° 1 of Table 1 | 2 g/l |
| Compound N° 3 of Table 1 | 2 g/l |
| Compound N° 8 of Table 2 | 0.1 g/l |
| Compound N° 2 of Table 2 | 0.1 g/l |
| Compound N° 3 of Table 3 | 0.5 g/l |
| Compound N° 11 of Table 3 | 0.1 g/l |
| Compound N° 1 of Table 4 | 0.3 g/l |

Very bright and levelled tin electrodeposits are obtained at 0.2-9.0 A/dm$^2$ cathodic current density and under cathodic agitation.

EXAMPLE 5—Fluoborate bright tin electroplating bath

| | |
|---|---|
| Tin fluoborate | 60 g/l |
| Fluoboric acid | 80 g/l |
| Compound N° 4 of Table 1 | 5 g/l |
| Compound N° 4 of Table 2 | 0.2 g/l |
| Compound N° 6 of Table 3 | 1.3 g/l |
| Compound N° 5 of Table 4 | 0.1 g/l |

Uniform and bright tin electrodeposits are obtained at 0.5 to 6.0 A/dm$^2$ cathodic current density and under cathodic agitation.

The additives described in the present invention may also be utilized to obtain uniform and bright electrodeposits of tin-lead alloy (approx. 60% Sn—40% Pb):

EXAMPLE 6—Tin-lead electroplating bath

| | |
|---|---|
| Lead fluoborate | 5 g/l |
| Tin fluoborate | 15 g/l |
| Fluoboric acid | 100 g/l |
| Boric acid | 15 g/l |
| Compound N° 2 of Table 1 | 8 g/l |
| Compound N° 1 of Table 2 | 0.15 g/l |
| Compound N° 1 of Table 3 | 1.3 g/l |
| Compound N° 3 of Table 4 | 0.4 g/l |

Under 1.0 to 7.0 A/dm$^2$ cathodic current density and cathodic agitation, uniform and bright tin-lead alloy electrodeposits are obtained.

The present invention is not limited to the above examples. The examples however will make apparent to one skilled in the art how to apply all the formulas and methods within the scope of this invention.

I claim:

1. An acidic aqueous tin electroplating bath comprising:

(a) stannous tin ions;

(b) at least one acid selected from the group consisting of sulfuric acid and fluoboric acid;

(c) about 1.0 to 20.0 grams per liter of a dispersing agent;

(d) about 0.1 to 5.0 grams per liter of a member selected from the group consisting of: aliphatic nonsaturated acids having 3 to 6 carbon atoms in the molecule, aliphatic esters of said nonsaturated acids, and amides of said nonsaturated acids; and (e) about 0.2 to 0.7 grams per liter of a brightener dispersed in the said bath and defined by the general formula:

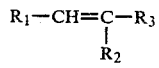

I.

wherein:

(A) $R_1$ is a member selected from the group consisting of:

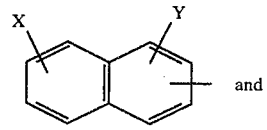

II.

and

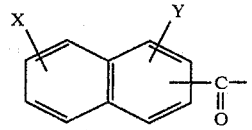

III.

wherein X is a member selected from the group consisting of a hydrogen atom; a halogen atom; and a substituent selected from the hydroxy, alkoxy, and alkyl groups; and Y is a member selected from the group consisting of a hydrogen atom; a halogen atom; and a substituent selected from the hydroxy, alkoxy, and alkyl groups; and (B) $R_2$ is a member selected from the group consisting of hydrogen and alkyl; and (C) $R_3$ is $$R_3 \text{ is } -\underset{\underset{O}{\|}}{C}-R_4 \qquad (C)$$

when $R_1$ is II., and $R_3$ is a member selected from the group consisting of:

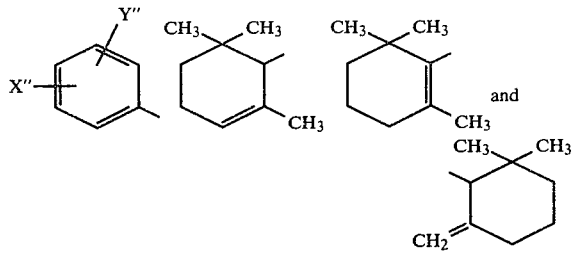

when $R_1$ is III., X″ being hydrogen, halogen, hydroxy, alkoxy, alkyl, sulfoxy, carboxy, amino, amido, or together with Y″ a methylenedioxy group, and Y″ being hydrogen, halogen, hydroxy, alkoxy, alkyl, sulfoxy, carboxy, amino, amido, or together with X″ a methylenedioxy group;

(D) $R_4$ is a member selected from the group consisting of alkyl, phenyl, hydroxyphenyl, alkoxyphenyl, dialkoxyphenyl, alkylphenyl, pyridyl, alkylpyridyl, and hydroxypyridyl.

2. The bath as defined in claim 1 wherein said brightener is the 4-(1-naphthyl)-3-butene-2-one:

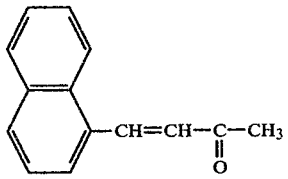

3. The bath as defined in claim 1 wherein said brightener is:

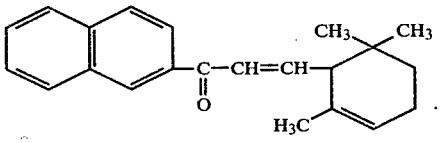

4. The bath as defined in claim 1 wherein said dispersing agent is the ethoxylated beta-naphthol.

5. The bath as defined in claim 1 wherein said dispersing agent is the nonylphenoxypoly(ethyleneoxy)ethanol with 10 moles of ethylene oxide in its molecule.

6. The bath as defined in claim 1 wherein said member is an aliphatic nonsaturated acid and said aliphatic nonsaturated acid is the propiolic acid:

$$HC\equiv C-\overset{\overset{O}{\|}}{C}-OH$$

7. The bath as defined in claim 1 wherein said member is an aliphatic ester of unsaturated acid and said ester is the hydroxyethyl acrylate.

8. An acidic aqueous tin electroplating bath comprising:

(a) stannous tin ions;

(b) at least one acid selected from the group consisting of sulfuric acid and fluoboric acid;

(c) about 1.0 to 20.0 grams per liter of a dispersing agent;

(d) about 0.2 to 0.7 grams per liter of a brightener dispersed in the said bath and defined by the general formula:

$$R_1-CH=\underset{\underset{R_2}{|}}{C}-R_3 \qquad \text{I.}$$

wherein:

(A) $R_1$ is a member selected from the group consisting of:

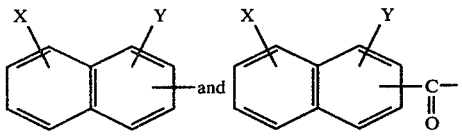

II. III.

wherein X is a member selected from the group consisting of a hydrogen atom; a halogen atom; and a substituent selected from the hydroxy, alkoxy, and alkyl groups; and Y is a member selected from the group consisting of a hydrogen atom; a halogen atom; and a substituent selected from the hydroxy, alkoxy, and alkyl groups; and (B) $R_2$ is a member selected from the group consisting of hydrogen and alkyl; and (C) $R_3$ is $$R_3 \text{ is } -\underset{\underset{O}{\|}}{C}-R_4 \qquad (C)$$

when $R_1$ is II., and $R_3$ is a member selected from the group consisting of:

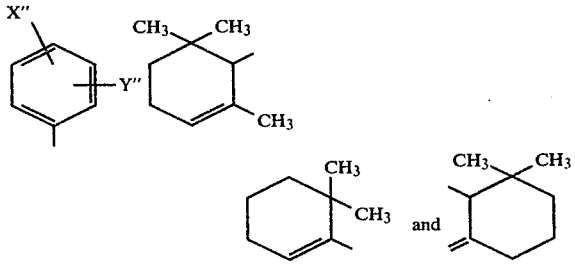

when $R_1$ is III., X″ being hydrogen, halogen, hydroxy, alkoxy, alkyl, sulfoxy, carboxy, amino, amido, or together with Y″ a methylenedioxyl group, and Y″ being hydrogen, halogen, hydroxy, alkoxy, alkyl, sulfoxy, carboxy, amino, amido, or together with X″ a methylenedioxy group; and (D) $R_4$ is a member selected from the group consisting of alkyl, phenyl, hydroxyphenyl, alkoxyphenyl, dialkoxyphenyl, alkylphenyl, pyridyl, alkylpyridyl and hydroxypyridyl; and (e) an effective amount of a heterocyclic quarternary compound of formula:

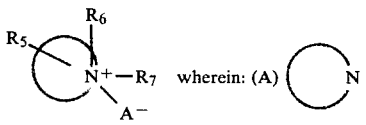

is a member selected from the group consisting of pyridine, quinoline and isoquinoline;

(B) $R_5$ is a member selected from the group consisting of a hydrogen atom, a halogen atom, hydroxy, alkyl, alkoxy, carboxy, carboxy-ester, sulfoxy, amino, amido, and acetyl group; and $R_6$ is a member selected from the group consisting of a hydrogen atom, a halogen atom, hydroxy, alkyl, alkoxy, carboxy, carboxy-ester, sulfoxy, amino, amido and acetyl group; and (C) $R_7$ is alkyl, alkenyl, alkynyl, benzyl, alkylphenyl, hydroxyalkyl, haloalkyl, carboxy-substituted alkyl group, and carboxy-substituted alkylphenyl group; and (D) A is a member selected from the group consisting of an anion and nothing when the polarity of the nitrogen atom is neutralized by another constituent of the molecule of said heterocyclic quarternary compound.

9. The bath as defined in claim 8 wherein said quaternary compound is present, in solution, in concentration of 0.05 to 2.0 grams per liter of bath.

10. The bath as defined in claim 8 wherein said quaternary compound is:

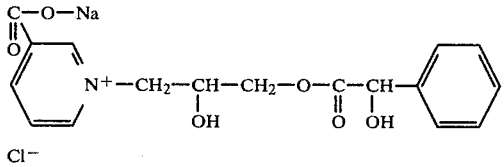

11. The bath as defined in claim 8 and containing, additionally, an aliphatic non saturated acid of 3 to 6 carbon atoms in its molecule.

12. The bath as defined in claim 11 and containing also, dissolved therein, a lead salt.

13. A method of electrodepositing bright tin on an article which comprises making said article the cathode in an electroplating bath in conformity with any one of claims 2 to 12 and 1.

* * * * *